United States Patent [19]

Peil

[11] 4,232,252

[45] Nov. 4, 1980

[54] LIGHTING NETWORK INCLUDING A GAS DISCHARGE LAMP AND STANDBY LAMP

[75] Inventor: William Peil, North Syracuse, N.Y.

[73] Assignee: General Electric Company, Syracuse, N.Y.

[21] Appl. No.: 29,954

[22] Filed: Apr. 13, 1979

Related U.S. Application Data

[63] Continuation-in-part of Ser. No. 909,300, May 24, 1978, abandoned.

[51] Int. Cl.[3] ..... H05B 41/46

[52] U.S. Cl. ..... 315/92; 315/87; 315/91; 315/135

[58] Field of Search ..... 315/87, 88, 91–93, 315/119, 121, 129, 135, 136; 307/130; 362/21

[56] References Cited

U.S. PATENT DOCUMENTS

| | | | |
|---|---|---|---|
| 3,517,254 | 6/1970 | McNamara, Jr. | 315/93 X |
| 3,873,882 | 3/1975 | Gershen | 315/92 |
| 3,927,348 | 12/1975 | Zawadski | 315/88 |

FOREIGN PATENT DOCUMENTS

| | | | |
|---|---|---|---|
| 1167444 | 4/1964 | Fed. Rep. of Germany | 315/92 |

*Primary Examiner*—Eugene R. LaRoche
*Attorney, Agent, or Firm*—Richard V. Lang; Carl W. Baker; Philip L. Schlamp

[57] ABSTRACT

A lighting network is described which includes a main gas discharge lamp, a standby lamp and a control circuit. The control circuit senses when the gas discharge lamp is operating normally and turns off the standby lamp. When the discharge lamp is not up to full light output after ignition or has gone out due to a momentary power interruption, the control circuit turns on the standby lamp. The control circuit includes a transistor amplitude discriminator and an electronic switch. The discriminator, which senses the voltage at the discharge lamp terminals, has a transfer characteristic which produces a "low" output over a "normal" range of terminal voltages and a "high" output for terminal voltages below and above the normal range. The electronic switch responds to "high" and "low" discriminator outputs to turn on or turn off the standby lamp, respectively. The discriminator is realized in its simplest form by a transistor amplifier comprising a junction transistor in the emitter common configuration with an emitter connected resistance. The voltages at the discharge lamp terminals are coupled to the transistor input junction through a step down transformer. The transformed voltages effect large signal operation of the transistor taking it through cut-off; the active region with inverting signal transfer and gain; and finally high current saturation in which a voltage drop is produced in the emitter resistance to achieve a non-inverting unity gain signal transfer to produce the respective high, low and high outputs. A preferred electronic switch is a silicon controlled rectifier for control of the standby lamp.

15 Claims, 8 Drawing Figures

FIG. 1
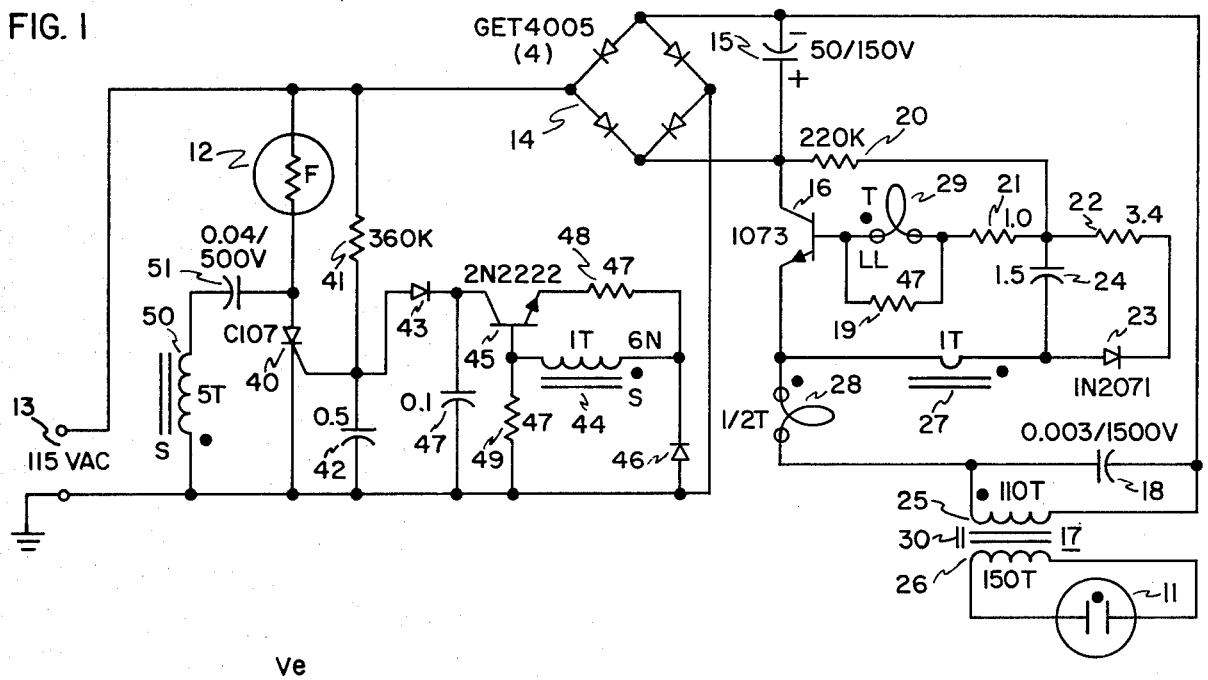
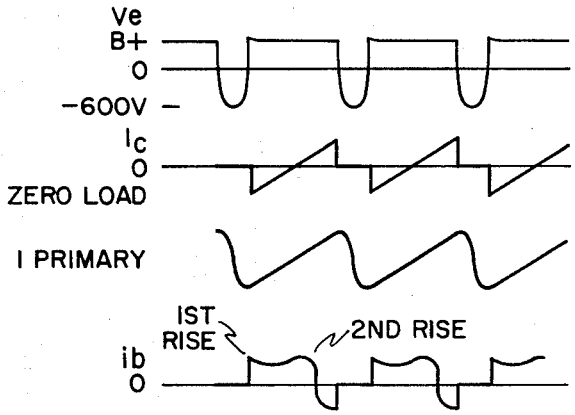
FIG. 2
FIG. 3
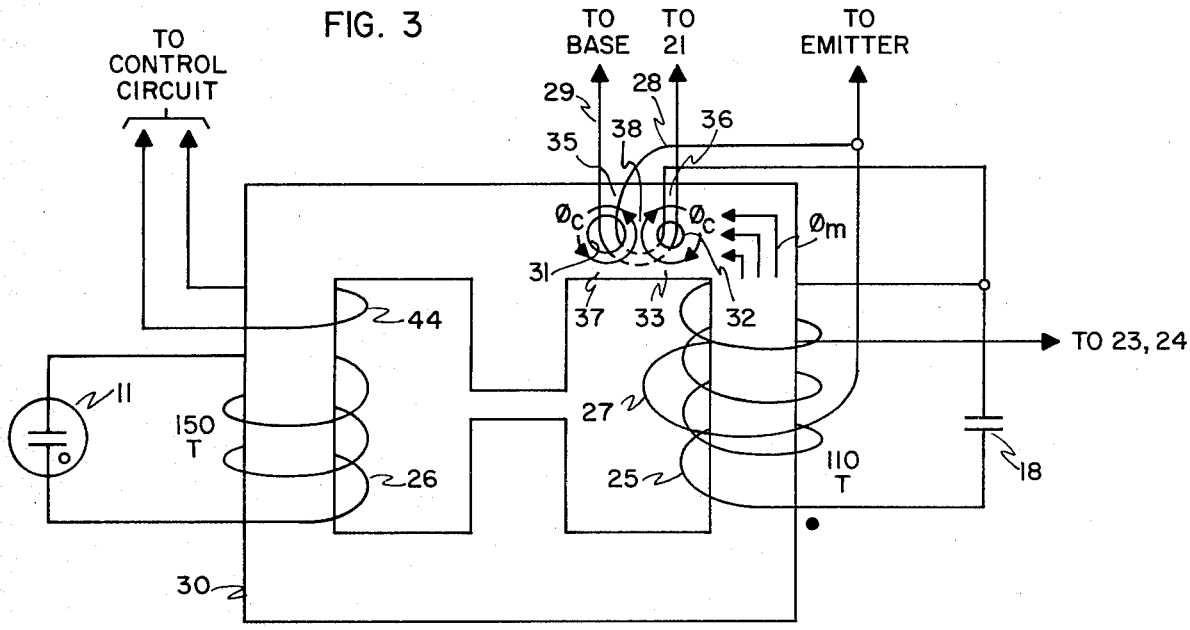

LIGHTING NETWORK INCLUDING A GAS DISCHARGE LAMP AND STANDBY LAMP

This is a Continuation in Part of application Ser. No. 909,300, filed May 24, 1978, now abandoned.

BACKGROUND OF THE INVENTION

1. Field of the Invention

The present invention relates to a lighting network, and more particularly to a lighting network in which the principal light source is a gaseous discharge light source for which a standby light source is needed during the low light output warm-up period or when it has gone out, and requires restarting. Such lighting networks require control means for sensing the condition of the principal light source, and for turning on the standy light source when the principal light source is not up to brightness.

2. Description of the Prior Art

It has been recognized that a gaseous discharge light source may need to be supplemented with a standby light source in some applications. It has also been recognized that the voltage across the gaseous discharge lamp in the conventional power supply can be an indirect indication of the light output of the gaseous discharge device. In particular, when the light source has gone out the voltage at the light source terminals will rise, since power supplies for gaseous discharge light sources to some degree must be current sources. Likewise, it is known, that once the arc in a gaseous discharge light source has ignited, which may require a voltage ten times the operating voltage, the voltage will immediately fall to a low value typically about one-third the normal operating voltage. Under this starting condition, current limiting in the power supply is mandatory to preserve the electrodes from self destruction. During the period of low arc voltage, the light output is low. As the starting period continues, the arc, which is first supported by the ionized argon or other natural gases, is supplemented by mercury which is initially a liquid. The mercury must next become vaporized and then ionized to enter into the light generation process. As the internal temperature continues to rise in the light source, the gas pressure builds up. With the growth in gas pressure, the voltage of the arc rises threefold to the normal voltage range. At the same time, the light source reaches its normal brightness. Should the light source go out, restarting is difficult, and normally requires time for the light source to cool to some degree. With cooling, the internal pressures fall, and re-ignition with reasonable voltages again becomes possible. A lamp which ignites at 1000 volts when cool may require 20,000 volts for ignition at high temperatures. Interruptions in line voltage on the order of a few milliseconds will invariably extinguish the light source, and then some delay will be required for cooling and recycling before full brightness can be restored.

In recognition of the relationship between the terminal voltage of a gaseous discharge light source and its light output, it has been proposed to connect a voltage breakdown device, such as a diac, in series with a standby incandescent light source in parallel with the gaseous discharge light source. When the gaseous discharge light source is lighted, the voltage across the terminals is insufficient to break down the diac, and the incandescent light source remains unlit. Should the gaseous discharge light source go out, the lamp terminal voltage will climb to a voltage adequate to break down the diac and turn on the incandescent light source. A diac shunt circuit has the disadvantage that it constitutes a load to any ignition voltage in excess of the disc breakdown potential, and poses problems for both the initial cold start and the hot restart, where the ignition potentials are even higher. Breakdown devices connected into the gaseous discharge lamp circuits have been proposed for sensing both low arc voltage and the high voltage resulting from extinction of the arc. Answers to the starting problem posed by a shunt connected breakdown device, have been to stack two to achieve higher breakdown potentials or to place a diode in series with the diac and the incandescent light poled to allow the standby circuit to load only the half cycles of the ac power source not used for developing the high ignition voltage.

SUMMARY OF THE INVENTION

Accordingly, it is an object of the present invention to provide an improved lighting network employing a main gas discharge lamp and a standby lamp.

It is another object of the present invention to provide a lighting network having an improved control circuit for sensing the condition of a main gas discharge lamp and turning on a standby lamp when the main lamp is not up to brightness or has gone out.

It is still another object of the invention to provide a lighting network having an improved control circuit for sensing the voltage at the terminals of a main gas discharge lamp to determine when a standby lamp should be turned on.

It is an additional object of the present invention to provide a lighting network having a simplified control circuit for sensing low or high terminal voltages in a gas discharge lamp.

It is an object of the present invention to provide an improved lighting network including a gas discharge lamp and a standby lamp having an improved starting circuit for the gas discharge lamp.

These and other objects of the invention are achieved in a novel lighting network which comprises a main gas discharge lamp, a standby lamp, power supplies for the lamps and control means for turning on the standby lamp when the gas discharge lamp is not up to brightness or has gone out. The gas discharge lamp may be characterized as having four states. A first ambient or low temperature off state having a low gas pressure and a normal breakdown potential; a second operating temperature off state having a normal gas pressure and an elevated breakdown potential; a third ambient or low temperature ignited state having a below normal gas pressure, a low arc voltage and low light output; and a fourth operating temperature ignited state having a normal gas pressure, a normal arc voltage and normal light output. While it is important to distinguish between an ambient temperature off state and an operating temperature off state in re-ignition, for purposes of controlling the standby lamp, the two off states need not be distinguished since both produce high lamp terminal voltages and require supplemental light. In standby lamp control therefore three states are important, the "off" state, a low voltage, low light output warm-up state and a normal voltage, normal light output, normal operating state.

The control means, which discriminates between these three states for standby lamp control, includes an amplitude discriminator, means for coupling a voltage proportional to the voltage across the main lamp to the discriminator, and switching means responsive to the discriminator output for applying power to the standby lamp when the proportional voltage indicates the need for standby illumination.

More particularly, the amplitude discriminator comprises a transistor amplifier exhibiting cut-off at a low input range, active operation with input inversion at an intermediate input range; and an uninverted input transfer at a high input range to effect a transfer characteristic in which electrical inputs in the low, intermediate and high ranges respectively produce an output quantity in respectively a first range, a second range distinct from the first range, and the first range again. The proportional coupling means couples a voltage proportional to the voltage across the main lamp to the discriminator of the correct magnitude to effect cut-off when the main lamp is in the low voltage, low temperature ignited state; active input inversion when the main lamp is in the normal voltage, operating temperature ignited state, and an uninverted input transfer when the main lamp is off and has an elevated voltage.

In a first practical embodiment, the transistor amplifier comprises a junction transistor having base, emitter and collector electrodes forming an input and an output junction and an emitter connected resistance. The proportional voltage coupled to the discriminator input at the transition from cut-off to active input inversion corresponds to the voltage required to forward bias the input junction, and during the uninverted input transfer corresponds to the voltage required to forward bias the output junction and to develop a voltage drop in the emitter resistance.

In a second practical embodiment, the transistor amplifier comprises a junction transistor, a base connected resistance and a diode shunting the resistance and the output junction and of similar polarity to the output junction. In this embodiment, the proportional voltage at the transition from cut-off to active input inversion corresponds to the voltage required to forward bias the input junction, and during uninverted input transfer corresponds to the voltage required to forward bias the diode and to develop a voltage drop in the base resistance.

In a third practical embodiment, the transistor amplifier comprises a field effect transistor of the n-channel enhancement mode, having gate, source and drain electrodes, biasing means for providing a positive bias to the drain and a negative bias to the source, and a diode coupled between the gate and drain electrodes poled to permit current flow from the gate to the drain. The proportional voltage at the transition from cut-off to normal operation of the amplifier corresponds to the threshold of the field effect transistor, and during the uninverted input transfer corresponds to the voltage required to forward bias the diode.

The proportional coupling means is a single turn winding on a leg of the core of the power transformer for the main lamp, through which leg the flux for powering the lamp flows.

For positive switching, when the switching means is a silicon controlled rectifier turned on by a positive gate potential, the transistor is an NPN transistor whose emitter is offset below reference potential by a diode drop causing the collector potential of the transistor to be above ground in one output range and below ground in the other output range. The collector is then coupled through a diode to the gate of the SCR. The gate, which is also coupled to a phase shift network, comprising a capacitor and a resistance, is clamped below firing potential in the second discriminator output range, and allowed to rise to SCR firing potential by the blocking action of the diode in the first discriminator output range.

In accordance with a further aspect of the invention, a quick restart circuit is provided associated with the standby circuit.

BRIEF DESCRIPTION OF THE DRAWING

The novel and distinctive features of the invention are set forth in the claims appended to the present application. The invention itself, however, together with further objects and advantages thereof may best be understood by reference to the following description and accompanying drawings, in which:

FIG. 1 is an electrical circuit diagram of a light network including control means for sensing the condition of a gas discharge lamp and turning on a standby lamp, the control means using a first form of transistor amplitude discriminator;

FIG. 2 is an illustration of the waveforms useful in explaining the operation of the dc to ac inverter in the lighting network of FIG. 1;

FIG. 3 is a drawing illustrating the magnetic core and the winding associated with the core of the transformer used in the inverter of FIG. 1;

DESCRIPTION OF PREFERRED EMBODIMENT

Figure 4:
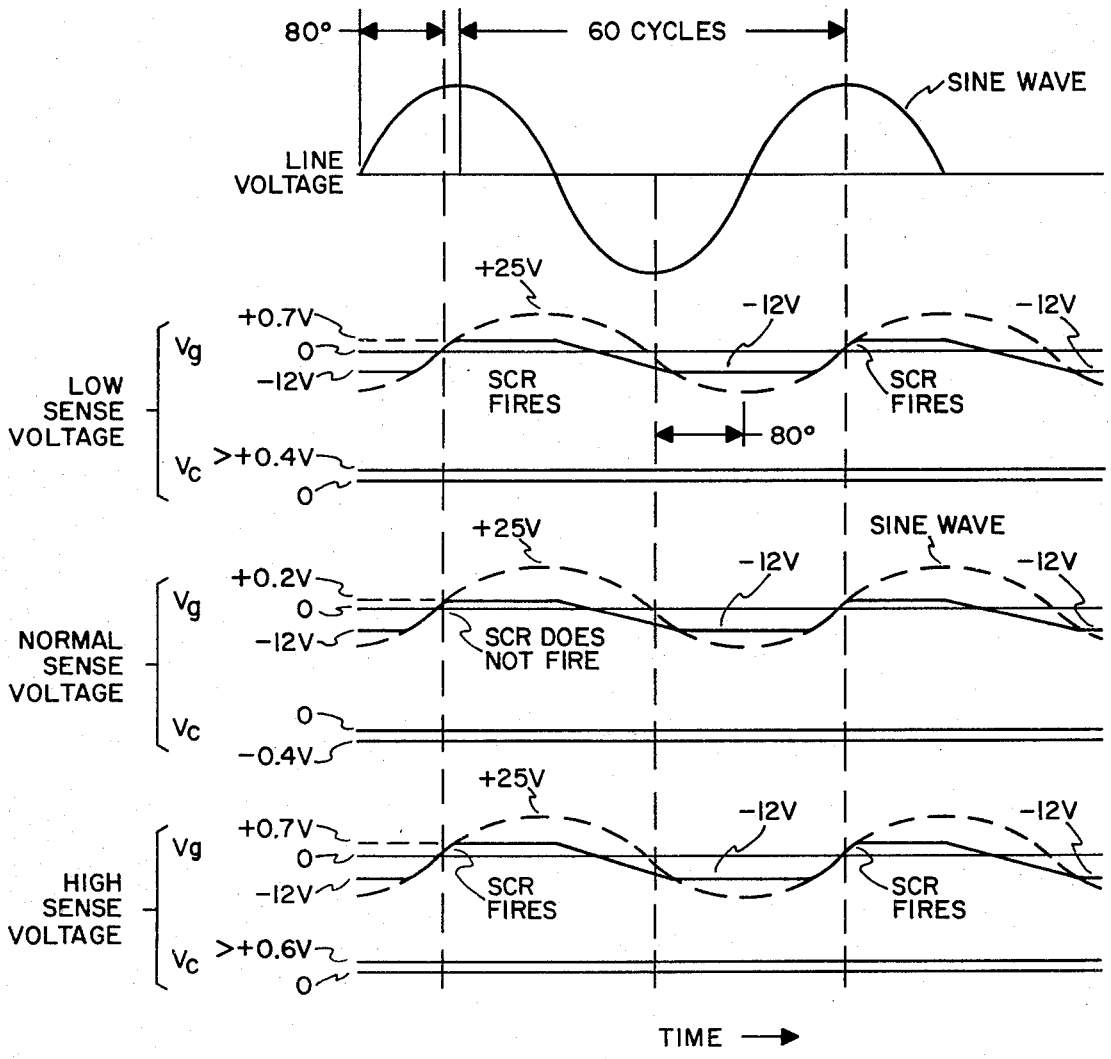
FIG. 4 illustrates the waveforms appearing in the control means for control of the standby lamp.

Referring now to FIG. 1, a lighting network is shown for starting and operating a high efficiency gas discharge lamp and for operating a standby lamp when the gas discharge lamp is not up to brightness or is extinguished. The lighting network, which performs the above recited functions operates the gas discharge lamp 11, and the standby lamp 12. The standby lamp is typically an incandescent lamp. The two light sources (11,12) may be in independent envelopes or combined into a unitary envelope.

The gas discharge lamp 11 typically contains an ionizable gas such as argon, mercury in a liquid state (at ambient temperature) and a pair of electrodes between which an arc can be struck. There may also be traces of other gases. On occasion, a starting electrode is also provided, disposed to support a lower voltage arc than would be provided between the principal electrodes. The electrodes, the mercury and argon are sealed within an arc tube, normally of glass or quartz.

When a gas discharge lamp is operated, it may be regarded as exhibiting four states. The first state is an "off" state, without an arc, at low temperature, normally the ambient temperature. The contained gases are at low temperature and the voltage required to strike an arc is a minimum. This condition is the one defining the "normal" breakdown potential. A second state occurs when the gas discharge lamp has just been ignited, but remains below operating temperature and at a lower pressure than the operating pressure. Under these conditions, the arc voltage is low, being supported primarily by ionized argon at a low pressure, with the mercury as yet unvaporized. In this state, the power supply must be regulated to avoid too large a current, since an unregulated arc will dissipate excessive power and destroy the electrodes. In the second state a low light output is produced. The third state occurs when the light source is at normal operating temperature and ignited. In the third, or operating state, the gas pressure has reached its normal value. While restriking an arc would require an elevated potential, the voltage required to maintain an arc is "normal" and a normal light output is produced. During the operating state, both the argon and vaporized mercury contribute to the light output. In the event that the voltage is momentarily interrupted during the third state and the arc has gone out, the fourth state occurs. At operating temperature, the contained gases are at elevated pressures with respect to a cold device and the voltage requirements for re-establishing an arc are elevated. Conventionally, it is impractical to achieve immediate re-ignition. Thus, a delay is normally required to allow the discharge lamp to cool off and the internal pressure to fall to the point where ignition at some more moderate breakdown potential is practical. As will be described hereafter, quick re-ignition, faster by typically 20–30 seconds, may be achieved by providing an appreciably elevated breakdown potential.

In the light source contemplated in the present application, power is supplied to the gas discharge lamp from a 25–35 kilohertz power supply with a typical operating potential of approximately 100 volts. During the warm up process, the arc voltage falls to around 20 volts. The voltage required to strike an arc at ambient temperature may be 1,000 volts. The power supply provides a typical "quick" restart capability of 4,000 to 5,000 volts peak to peak at a nominal frequency of 200 kilohertz.

For purposes of controlling a standby lamp, the gas discharge lamp has three distinct states. The two off states produce a high voltage at the gas discharge lamp terminals in a standard power supply configuration, and may be treated as one state of which the warm up state is another, and the normal operating state the third. During both the off state and the warm up state, a supplement for the light output of the gas discharge lamp is needed and this is done by turning on the standby lamp. When the gas discharge lamp is operating normally, the standby lamp should be turned off.

The three states of illumination of a gas discharge lamp are electrically distinctive. The amount of light that is being produced can be inferred from these electrical conditions, and a standby lamp can be turned on when the output of the discharge lamp is below the desired light level by a control means responsive to electrical conditions. When the lamp is connected in circuit with a power supply having "typical" internal regulation, the voltage across the lamp will be a good indication of which state the lamp is in, and by inference the light output. Assuming that the normal operating voltage (i.e., arc voltage) is 60 volts, any time that the arc voltage is near 60 volts, one may infer that the light output is normal and need not be supplemented. When the arc goes out, reducing the light output to zero, the voltage across the lamp electrodes will climb to 120 volts assuming typical regulation (or more). Assuming typical regulation, the arc may be expected to fall to 20 volts during the early part of the warm up cycle before the light output is up to the normal light output. Thus, an abnormally low or an abnormally high voltage across the lamp electrodes is an indication of a low light output and of the need for a standby light source. The control means depends upon this principle, turning on the standby lamp when the electrode voltage of the discharge lamp is too low or too high and turning off the standby lamp when the electrode voltage lies between the limits characteristic of normal operation.

The lighting network, in addition to the two light sources, has as its principal components a dc power supply with input terminals 13 for coupling to a 120 volt, 60 hertz ac source, and comprising a bridge rectifier 14, and a filter capacitor 16; an inverter for converting electrical energy supplied by the dc power supply to an ac for providing ac operating potentials for the gas discharge lamp; a power supply for the incandescent lamp 12; and a control circuit for turning on the incandescent lamp when the discharge lamp is not up to brightness (or extinguished). A further component in the power supply is an optional means for achieving a quick restart.

The dc to ac inverter is in itself the invention of another. The inverter comprises a power transistor 16, a power transformer 17 and sundry circuit elements 18–24 associated with starting and control of transistor 16, the combination functioning as a blocking oscillator typically operating at 26 kilohertz. The power transformer 17, more particularly, has a ferrite core 30 having a controlled leakage inductance, a primary winding 35, a secondary winding 26 and a feedback winding 27 all coupled about the full core cross section. The power transformer also has a first and a second control winding 28 and 29, both led through a double aperture of the core and coupled together for coupling to a transverse flux path within the core, as will be described in greater detail in connection with FIG. 3.

The dc to ac inverter uses the transformer 17 and the transistor 16 in a blocking oscillator configuration with feedback provided by the feedback winding 27 and the control windings 28, 29. The collector of the transistor is connected to the positive terminal of the filter capacitor 15, which is also the positive terminal of the dc source. The emitter is coupled through control winding 28 to the dotted terminal of the transformer primary winding 25. The undotted terminal of the primary winding is returned to the negative terminal of the filter capacitor 15 which is the negative terminal of the dc source 11, thus completing the primary current path. A capacitor 18 shunts the primary winding 25 and forms a parallel resonant circuit. The secondary winding 26 of the transformer, across which the ac output of the inverter appears, is coupled to the terminals of the discharge lamp 11 for energization thereof. The control winding 28, through which the primary current flows, "senses" the primary current and acts in concert with the second control winding 29, and the remainder of the control circuitry including winding 27 to establish both the conditions for oscillation and to optimize the drive applied to the transistor input electrodes to maximize the switching efficiency with minimum transistor stressing.

The transistor starting and control circuitry includes the feedback winding 27, control winding 29, resistors 19 to 22, diode 23 and capacitor 24. The starting circuit includes resistor 20 and 22 and diode 23 and indirectly the capacitor 24. The resistor 20 is coupled between the collector of transistor 13 (at the positive terminal of the dc source) and a path leading to the base of transistor 16 including, in order, resistor 21 and the control winding 29, the latter shunted by resistor 19. The capacitor 24 has its second terminal coupled to the dotted terminal of feedback winding 27. The undotted terminal of the feedback winding 27 is connected to the emitter of transistor 16. The capacitor 24 is shunted by a series circuit formed by resistance 22 and diode 23. The cathode of diode 23 is coupled to resistance 22 and its anode is coupled to the second terminal of capacitor 24. The resistor 20 forms a current path through elements 21, 29 and 19 to the base, which forward biases the junction and causes the transistor to conduct. The diode 23 is poled to facilitate forward base current injection and to prevent the diversion of starting current. It also serves to increase the reverse current impedance during oscillation. If the conditions for oscillation are present, the onset of current in transistor 16 also initiates oscillation. During oscillation, the capacitor 24 shunts the diode 23 and resistance 22 and carries the ac component of the base drive. The dc component of the base drive is established by the resistance 22 and the forward drop of diode 23.

Sustained oscillation is achieved by the joint action of the transistor 16; the feedback winding 27 and control windings 28 and 29; and the primary winding 25 of the transformer and capacitor 18. The primary winding 25 and capacitor 18 provide an LC resonant tank circuit into which energy is periodically injected by transistor 16, and from which energy is continuously extracted by the load, and also periodically extracted and re-injected into the transistor 16 to sustain oscillation. The feedback and control windings provide the feedback in correct phase to sustain oscillation and to optimize transistor switching.

The inverter oscillates in the following manner. The transistor 16 is initially turned on by base current injected through resistor 20. When transistor 16 is normally conducting, emitter current flows through control winding 28 and the transformer primary 25 toward the negative source terminal. Assuming that the transistor 16 has been conducting and is now turned off, the oscillatory tank circuit, which stored energy during transistor conduction, releases the energy stored in the magnetic field in an oscillatory manner. As the magnetic field collapses, the induced voltage applies a reverse charge to the capacitor 18. As the reverse charge builds up on the capacitor, the current flow decreases toward zero. At zero current flow, the negative voltage across the tank circuit reaches a maximum value several times the dc source voltage. The current now reverses and grows to a large negative value. The surge, however, is halted at slightly (two diode drops) above the dc source voltage by the clamping effect of the diode 23 and transistor 16. The current flow from the resonant circuit flows, via diode 23 and resistance 22 and capacitor 24, into the foward biased base-collector junction of transistor 16 so that a surge of reverse collector current results. The surge continues until the base falls below the collector potential, terminating the reverse collector current flow. Simultaneously, the feedback winding 27, coupled between the emitter and base and responding to the current reversal in the primary winding 25 in proportion to the voltage turns ratio, produces a positive-going step, foward biasing the base-emitter junction of the transistor. The transistor soon begins to conduct normally, with the current from the positive terminal of the dc source flowing in the collector and emitter current flowing through the current sensing control winding 28 and in the tank circuit toward the negative terminal of the dc source. Acting as a current transformer, control winding 28 couples current to base connected control winding 29 inducing a further forward bias to the input junction, and carrying the transistor quickly to saturation. Full conduction continues until selective core saturation is sensed. When such saturation is sensed, the forward drive applied to the base by the control winding 28 is reduced, then inverted to sweep out stored charge in the base region, bringing the transistor to a quiescent, non-conductive state. The quiescent state lasts through a negative half cycle of the voltage swing of the resonant tank circuit. At the end of the half cycle, current is forced through the transistor by the voltage pulse from the voltage feedback winding and the cycle is repeated.

The waveforms of FIG. 2 illustrate the inverter operation just described. A full cycle of the oscillation is the sum of two half cycles of two different circuit mechanisms. During the shorter, half cycle, corresponding to the off time of the transistor, the LC resonant circuit comprising winding 25 and capacitor 18 swings through a half cycle from full forward to full reverse current. The duration of this past of the cycle, the "flyback" interval is set approximately by the respective values of these circuit elements. The duration of the tank circuit charging interval is set by the magnitude of the dc voltage, the conductivity of the transistor, the number of turns of the winding 25 and the amount of flux that the core will support before the onset of saturation.

In the wave shapes of FIG. 2, the first and uppermost graph is that of the voltage at the emitter of the transistor 16 connected through winding 28 to the dotted terminal of winding 25. The emitter voltage is a succession of resonant, negative going, half cycles, separated by a substantially longer, almost constant dc level, approximately equal to the B+ voltage. At the starting transient following the negative going swing, the potential may swing slightly past the B+ value, but it subsides to a value just slightly below B+. The graph of the collector current, which appears immediately below, contains an upward ramp, a sharp downward transient to zero, followed by an off period and a sharp downward transient to a reverse current state, from which the upward ramp starts. The period that the collector current is zero defines the flyback period of the resonant circuit, the period of reversed collector current flow represents the return of energy from the tank circuit to the supply, and the period that forward collector current flows corresponds to the application of energy to the tank circuit. When the load is light, the collector current is nearly symmetrical about a zero current as depicted. When the circuit is loaded, the shape of the ramp changes, and the average reverse current becomes smaller than the average forward current. The current in the transformer primary 25 is the third graph from the top. The primary current is a sawtooth in synchronism with the collector current with a coincident upward ramp. The fourth and lowermost graph is that of the base current of the transistor. The base current is strongly forward (into the base) for most of the upward part of the charging ramp, starting off with a spike, dipping and then peaking a second time before dropping strongly negative, a feature particularly useful to the removal of stored charge from the base. When the stored charge is removed, the transistor current becomes zero to begin the flyback interval. The zero value continues throughout the flyback pulse followed by the abnormal and normal transistor conduction periods. The physical arrangement of the control windings and their action in producing the base drive waveform will now be discussed.

FIG. 3 illustrates the core structure and the manner in which the windings are associated with the core in the transformer 17. In FIG. 3, the ferrite core 30 of transformer 14 is shown, having a rectangular principal flux path. The main magnetic flux path is operated with a non-symmetric bias on the B/H curve of the material. To reduce the required mass and cross-section a gap of 5–10 mills is frequency employed. This is applied in two places as indicated by the figure in that the core is assembled from 2 E sections with non-ferrous material—plastic or cardboard placed between them. A secondary path consists of a magnetic shunt with an air gap arranged between the centers of the upper and lower sides of the rectangle. Typical air gaps in the center leg are 10–50 mills. The shunt adds controlled leakage inductance which provides a variable voltage drop between the primary winding 25 and load connected secondary winding 26, and stabilizes the lamp current when the arc voltage falls to prevent the drawing of excessive power. The primary winding 25 and the voltage feedback winding 27 encircle the right side of the core (as seen in FIG. 3). The primary winding may be of approximately 100 turns while the feedback winding 27 is of a few turns, often one. The secondary winding 26 encircles the left side of the core. The secondary winding is of approximately 150 turns. The upperside of the core, between the side on which the primary winding is wound and the shunt contains a pair of apertures 31 and 32, through which the control windings 28 and 29 pass. In the illustration, the aperture 31 is larger than the aperture 32 and is located directly to the left of 31. Both apertures are typically arranged in the center of the upper arm so that the cross sections above and below the aperture 31 are equal, and smaller than those above and below aperture 32, which are also equal. The apertures should be spaced apart by a distance which is less than two arm widths and greater than the thickness to one side of an aperture. The windings 28 and 29 are of a few turns, typically one or two. Their physical disposition produces current transformer action between them via the core.

FIG. 3 illustrates the flux conditions in the vicinity of the double apertures. The main flux $\phi_m$ enters from the right uniformly distributed across the cross section of the core as illustrated by the bent arrows. In the vicinity of the apertures 31 and 32, however, a circulating flux ($\phi_c$) has now been created around each aperture as a result of current flowing in the control winding 28. (The serially connected control winding 28 carries the same current that flows through primary winding 25 and generates the main flux $\phi_m$.) The circulating flux in the control winding 28 is counter-clockwise around the aperture 31 and clockwise around the aperture 32. The flux distribution may be regarded as resulting from a pair of magnetomotive forces generating the main and circulating fluxes in a branched magnetic path. Until the onset of saturation, the flux may be treated as adding approximately linearly in a branch. Thus, in the branch 36 above aperture 32, the main and circulating fluxes subtract and the net flux is smaller there. In the branch 33, the main and circulating fluxes add and the net flux is greater. The flux is smaller in the branch 37 under the aperture 31 where the fluxes subtract. In the branch 35 above the aperture 31, the main and circulating fluxes add and the flux is greater. In the branch 38 where the main flux is near zero initially, the circulating fluxes add and are also small at first but grow appreciably as the cycle progresses. As collector current in windings 25 and 26 builds up, the circulating flux is exposed to a minimum reluctance path, a condition which produces the maximum drive in the base connected winding 29 and close coupling between the two control windings. As the cycle progresses, the circulating flux gradually increases to the point where branch 35 (having the smallest cross-section and the most flux concentration) saturates. This changes the reluctance around the first toroidal flux path. This brings about a reduction in the base drive available for the transistor (16), and starts the turn-off process. Saturation of branch 33 occurs next with an accompanying reversal of the current drive available to the base. Sweepout of stored charge in the junction is accomplished without undue voltage stress placed on the transistor by the base drive pictured in FIG. 2.

The control of transistor switching in the inverter may now be summarized. As implied by FIG. 1, a voltage proportional control is applied by the feedback winding 27 and current proportional control is applied by the control winding 29 during turn on. During turn off the action of the control winding 29 in response to the main flux generated by primary winding 25 is roughly proportional to the primary voltage, and substantially proportional to the increment of the main flux flowing through the control branch. The turn off action of the feedback winding 27 remains voltage proportional. The joint action of the two windings is illustrated in the last curve of FIG. 2. In particular, after a period of non-conduction the rising edge of the flyback pulse ($V_e$ graph of FIG. 2) produces a sharp step in the voltage feedback winding 27, which initiates base drive. Before this effect has diminished more than slightly, the feedback effects in winding 29 takes place. As the last stored charges in the transistor are swept out, the flyback pulse (graph $V_e$) generates a second voltage feedback pulse in winding 29, bringing reverse conduction to a complete halt. The flyback period, in which the transformer and the capacitor swing through a half cycle, continues through the transistor non-conduction period. When the resonant swing is completed, conduction is restarted by the first flyback pulse coupled to the voltage feedback winding 27. With the first flyback pulse, the conduction cycle in the dc to ac inverter commences all over again.

In addition to the ac to dc power supply, and the dc to ac inverter just described for the gas discharge lamp 11, the lighting network also includes an ac power supply for the incandescent lamp 12, a control circuit and a quick restart circuit.

The control circuit of the lighting network comprises a lamp condition sensing circuit which includes means for deriving a voltage proportional to that across the gaseous discharge lamp indicative of its light output, a transistor amplitude discriminator responsive to that proportional voltage, and switching means responsive to the discriminator output voltage for turning on or turning off the standby lamp. The amplitude discriminator is a transistor amplifier in which a transistor is connected in an emitter common configuration with an emitter resistance. The amplifier is operated in the large signal mode by the proportional voltage sensed at the gas lamp terminals. The proportional voltage drives the transistor through cut-off; normal operation—including linear signal inverting operation and light saturation; and finally heavy current saturation—where normal transistor action is suspended and a voltage drop proportional to the signal is produced in the emitter resistance. The three conditions produce high, low and high output voltages, respectively. The switching means, a silicon controlled rectifier 40, applies power from the 120 volt source to the incandescent light 12 for a high discriminator output voltage and disconnects power for a low discriminator output in a manner to energize the standby lamp when the main gas lamp is off or not up to full light output and to de-energize the standby lamp when the main gas lamp is at normal light output. The SCR gate voltage is jointly controlled by the transistor amplitude discriminator and a phase shift network as will now be described in detail.

The power for the incandescent lamp 12 is derived, as indicated above from the 120 V ac source under the control of the SCR 40. The power circuit for the incandescent lamp 12, including the SCR 40 and its phase shift network 41, 42, is connected as follows. One terminal of the lamp 12 is connected to one, the normally ungrounded, ac input terminal and the other lamp terminal is connected through the SCR 40 to the other, normally grounded, ac input terminal. More particularly, the anode of the SCR is coupled to the "other" lamp terminal and the cathode of the SCR is coupled to the normally grounded ac input terminal. The gate of the SCR 40 is connected to a phase shift network comprising a serially connected resistor 41 and a capacitor 42, and to a diode 43 coupled to the collector of amplifier transistor 44 at the output of the amplitude discriminator. By the connection of the resistance 41 between the ungrounded ac input terminal and the anode of diode 43, collector bias and a dc load is provided to the amplifier transistor 45 forming the heart of the amplitude discriminator. The resistor 41 is connected between the ungrounded ac input terminal and the gate of the SCR, and the capacitor 42 is connected between the gate of the SCR and the SCR cathode to complete the SCR phase control circuit.

The SCR, which is the switching means controlling the application of ac power to the incandescent lamp, has the following characteristics. An "SCR" is a four region semiconductor device for power applications having three junctions and three terminals. The anode terminal is coupled to a first p region (p1). The adjoining n region (n1) which completes the first junction (j1) is unelectroded. The next p region (p2) is electroded and becomes the gate electrode, and the last region, region (n2) is the cathode region. The second junction (j2) is formed between the (n1 p2) regions, and the third junction (j3) is formed between the p2 n2 regions. In operation, forward conduction is established by the first junction j1. When connected between an ac source and a favorable gate potential, an SCR will conduct during those half cycles that the first junction (j1) is forwardly biased. In the orientations of FIG. 1, conduction occurs when the normally ungrounded ac input terminal is positive with respect to ground. This implies that the serially connected standby lamp 12 will receive current no more than half of the time. A second property of an SCR is that once "ignited", i.e., made conductive, it will conduct as long as a certain minimum level of current is maintained. When connected in circuit with a low impedance load, such as a standby lamp, conduction is maintained after ignition through the balance of the forward conduction cycle, and turn off occurs when the polarity on the principal electrodes is reversed, precluding further forward conduction. The SCR is ignited (or turned on), assuming favorable voltages across its principal electrodes, by a voltage applied to the gate electrode which is adequate to momentarily forward bias the third junction. A common turn on voltage is approximately +0.7 volts, and the value is frequently subject to a substantial manufacturing variation (+0.4 to +0.8 volts).

The phase shift network 41, 42 is adjusted to deliver to the gate of the SCR a delayed and scaled down version of the voltage waveform at the 120 V 60 cycle input 13 adequate to turn on the SCR. With the indicated values in the phase shift network, an approximately 80° delay in respect to the ac input waveform occurs before the voltage at the gate has turned sufficiently positive (0.7 volts) to turn on the SCR. At this point in the ac input waveform, the instantaneous voltage is slightly below the 90° peak value. After being turned on 80° into the ac cycle, the incandescent lamp 12 is turned off at about 180° into the ac cyle, remains off for the remainder of the cycle, and then after 80° in the following cycle it is turned on again. In short, current flows in the lamp for approximately 100° in each 360° cycle. The resistance and wattage of the incandescent lamp is selected for appropriate light emission under these conditions. The standby lamp is selected to maintain some substantial fraction, for example 1/5 to ½, the brightness of the gaseous discharge lamp.

The state of the conduction of the SCR is a joint function of the phase of the ac source appearing in the phase shift network and the sensed lamp voltage. Assuming the lamp voltage sensing portions of the control network were not present, the phase shift network would ignite the SCR 40 at the pre-assigned phase angle for each cycle of the 60 cycle waveform as described above. The lamp condition sensing portions of the control network, which include the means for deriving a voltage proportional to the gas discharge lamp voltage and the transistor amplitude discriminator, permit the SCR to conduct at a phase angle determined by the phase shift network, but only when the amplitude discriminator output voltage is high. When the discriminator output voltage is low, the SCR is prevented from conducting and the incandescent lamp is kept unenergized.

The gas lamp condition sensing portions of the control circuit perform the function of determining from a measurement of the terminal voltage when the gas lamp is off or not up to brightness and produce a control voltage used to turn on or turn off the standby lamp as needed. In practice, the three conditions noted earlier are relevant. The proportional coupling means 44 and the transistor amplitude discriminator comprising elements 45–49 and elements 41, 42, 43 shared with the phase shift network, sense when the gas discharge lamp 11 is ignited and up to brightness and respond with a low output voltage. The same elements sense when the gas discharge lamp is not yet on or has gone out and respond with a high output voltage. When the gas lamp has just been turned on, and is being brought up to full brightness, the same elements respond with a high output voltage. The input voltage to the lamp sensing elements is a voltage sensed by the means 44, which produces a stepped down version of the terminal voltage of the gas lamp. The output voltage of the amplitude discriminator is coupled to the gate of the SCR. As will be explained, a low discriminator output voltage prevents the SCR from firing and keeps the standby lamp off and a high discriminator output voltage permits the SCR to fire, turning on the standby lamp. The sensing circuitry will now be treated in detail.

The proportional coupling means 44 is illustrated in the circuit drawing of FIG. 1 and in the drawing of the inverter transformer in FIG. 3. As illustrated in FIG. 3, it is the single turn winding 44, wound on the portion of the transformer core associated with the secondary winding (26) which powers the gas lamp 11. By this construction and physical intimacy with winding 28, the winding 44 derives a voltage proportional to the voltage across the secondary winding 26 and to the voltage across the gas lamp terminals.

The magnitude of the variation of the secondary voltage is selected for large signal operation of the transistor. In other words, the magnitude of the proportional signal is selected to keep the transistor cut off during lamp warm up; to keep the transistor in normal operation during the normal operating state of the gas discharge lamp, and to cause heavy current saturation and a substantial voltage drop in the emitter resistance if the lamp is off. At the transformer winding 44, in which the voltage proportional to the lamp voltage is derived, the secondary voltage need only vary from near zero (e.g. +0.3 volts) to near a volt (e.g. 1.1 volt) to a few volts (e.g. 2.0 volts) to get the full range of large signal operation required to produce the desired high-low-high amplitude discriminator transfer characteristic.

The transistor amplitude discriminator consists of a transistor amplifier to the input of which the voltage proportional to lamp voltage is coupled, and which produces in its output load the voltages desired for SCR control. The transistor amplifier comprises an NPN transistor 45, a degenerative emitter resistance 48, resistance 49, diode 46, capacitor 47, and previously noted elements 41, 42 and 43 forming the collector load. The circuit is electrically referenced to the normally grounded ac input terminal, with the base of the transistor 45 coupled to it through resistance 49. The emitter of transistor 45 is connected through the resistance 48 to the cathode of the diode 46, of which the anode is returned to the normally grounded ac input terminal. The one turn sense winding 44 is electrically connected between the base of the transistor 45 and the cathode of diode 46. The polarity of the voltage sensing winding connection is selected such that the induced voltage tends to turn on the base-emitter junction during the flyback interval of the blocking oscillator. The capacitor 47 is connected between the collector of the transistor 45 and the normally grounded ac input terminal. As noted earlier, the collector of transistor 45 is connected through diode 43 and resistance 41 to the ungrounded ac input terminal. The diode 43 also connects the collector of transistor 45 to the gate of the SCR 40 for effecting the control functions noted earlier. The diode 43 is poled so that current from the ungrounded ac terminal flows into the collector of 45 but not the reverse. Energization of the amplitude discriminator from the ac source is a low cost and simple mode of energization, with the discriminator becoming quiescent during negative half cycles of the ac waveform. The capacitor 42 charges in both directions at the 60 cycle rate and the diode 43 isolates the discriminator transistor from the negative voltage cycles. This allows the capacitor 47 to retain a stable charge from cycle to cycle and the circuit to supply the desired SCR control voltages needed during the positive half cycles of the ac source.

As will now be explained, a low discriminator output voltage holds the SCR gate below the firing potential and a high discriminator output voltage applies a firing potential to the SCR gate. Firing is achieved without affecting the SCR conduction angle.

The inverter, as earlier indicated, produces approximately 1000 volts when the light source is unlit, the voltage appearing in the secondary winding 26 coupled to the electrodes of the gas discharge lamp. When the gas discharge lamp is ignited, the voltage falls to the values named earlier, initially 20 volts, and when a normal light output is achieved, the "operating" voltage is typically 60 volts. The sense winding 44, in an open circuit condition, would be expected to exhibit approximately 1/150th the voltage on the secondary winding. In the circuit, the loading is substantial and the 50 to 1 voltage extremes that one might expect are moderated to a range of less than 10 to 1. Typically, the in circuit measurement of the voltage across the sense winding will produce 1.1 volts when under normal operating conditions, 2.0 volts during the ignition process (prior to ignition or after a loss in ignition) and 0.3 volt immediately after ignition to produce a voltage range of about 7 to 1.

Figure 5:
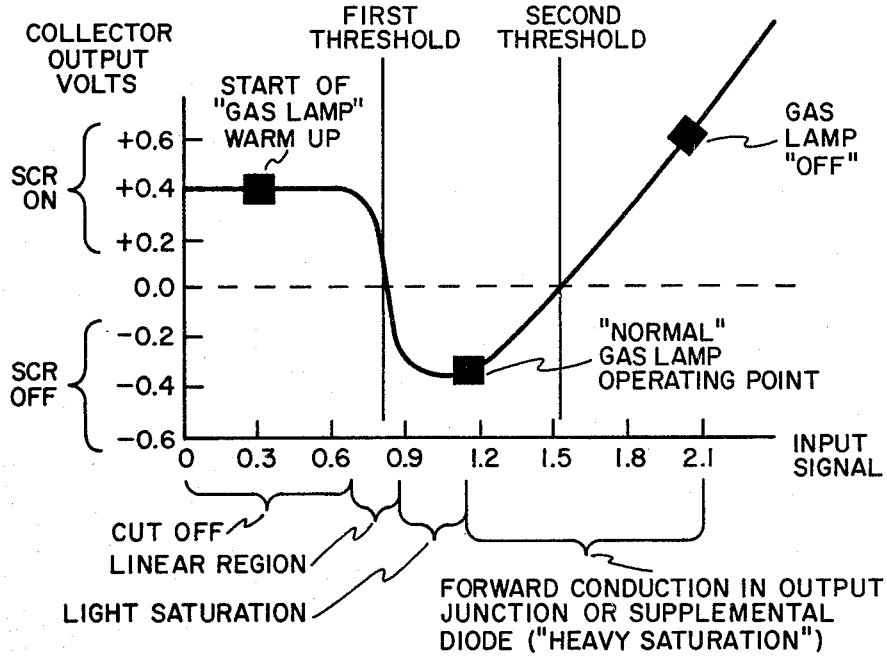
FIG. 5 illustrates the transfer characteristic exhibited by the transistor amplitude discriminator used in the control means.

By means that will now be explained with reference to FIG. 1, the amplitude discriminator produces a "low" output voltage when the voltage sensed in the sense winding lies in the vicinity of the "normal" gas lamp voltage corresponding to normal brightness and a "high" output voltage when the voltage sensed in the sense winding is substantially below or above this normal value. To achieve this property, the amplitude discriminator includes a transistor amplifier having a transfer characteristic defined in three successively larger input ranges, and producing respectively a high, a low, and a high output. A particularly simple circuit for achieving this transfer characteristic is the amplitude discriminator illustrated in FIG. 1. The transfer characteristic which relates the input to the output quantities, is shown in FIG. 5. FIG. 5 also identifies the input ranges in terms of the condition of the gas lamp, and the state of the transistor amplifier. The operation of the amplitude discriminator will now be described in the three lamp conditions.

During the short warm-up period immediately after main gas lamp ignition, the light output is low and the voltage induced in the sense winding 44 from the 28 kilohertz supply has the lowest value starting typically at 0.3 volts as seen in the leftmost portion of the FIG. 5 characteristic. This lies within the lowest input range of the amplitude discriminator and a "high" discriminator output voltage is produced. The sensed voltage is applied across the input junction of the transistor 45, but is insufficient to forward bias the input junction. Except for a very small leakage current, the transistor 45 is off. When the transistor 45 is off, current flowing in the resistance 41 charges the capacitor 42, and through the diode 43 may also charge the smaller capacitor 47 in the positive direction. Assuming that the SCR were not present (and 45 off) a minimum voltage drop occurs in the load resistance 41, and the amplifier output voltage would climb to a value set primarily by resistance 41 and the capacitors 42 and 47, typically about 25 volts. With the SCR present, the gate voltage increases to +0.7 volts, or more exactly the voltage at which the gate of the SCR becomes forward biased and the SCR ignites. The voltage at the gate normally does not increase past ignition. The collector of the transistor 45 rises to a small diode drop (that is through diode 43) below the SCR ignition potential to +0.4 volts or slightly less. Accordingly, during a low input voltage condition, corresponding to the gas lamp warm-up, the transistor amplitude discriminator produces a high output voltage of +25 volts under open circuit condition or the approximately +0.7 volts required for gate ignition, when connected to the gate of the SCR.

During transistor cut-off, the amplitude discriminator has negligible effect on the SCR firing angle. The transistor 45 appears as an open circuit, and does not discharge either capacitor 42 in the phase shift circuit or capacitor 47. The presence of capacitor 47, which may charge through diode 43, also has a negligible effect on the phase angle at which the SCR fires. Capacitor 47 has only one-fifth the capacity of capacitor 42. In addition, the diode 43 through which capacitor 47 charges, delays the charging of capacitor 47 until the "small" drop in diode 43 (normally 0.3 to 0.5 volts) has been exceeded, which occurs only shortly before the SCR ignition potential, a "large" diode drop is reached. In addition, the capacitor 47 in combination with the resistance 42 has a short time constant in respect to the ignition sequence, and after a few cycles of the ac waveform charges to the peak value (typically +0.4 volts) established by the actual component values. Since there is negligible current flow through the transistor 45, the capacitor 47 requires negligible current replenishment to maintain the peak voltage value. Thus, the SCR phase angle during transistor cut off is that set by components 41, 42.

In the low input voltage condition for the beginning of lamp warm-up, the transistor amplifier of the amplitude discriminator is in a cut-off condition, with no amplifier current flow and a maximum output voltage. At the same time, the voltage applied to the input junction of the transistor 45 is insufficient to provide a forward bias to the input junction. In this condition, the transistor itself is cut-off, since with a forward bias of only 0.3 V, negligible current flows in the input junction and in consequence, none resulting from normal transistor action flows in the output junction. In silicon devices, a forward bias of 0.7volts is required for conduction. Thus, so long as the lamp warm-up voltage derived by the proportional coupling means remains below cut-off potential (i.e., the $V_{eb}$), a unique property of the input junction of a transistor, a substantially fixed high output voltage (+0.4 volts) is produced by the amplitude discriminator, and the SCR 40 is turned on to turn on the standby lamp.

The conditions for a low sense voltage are depicted in the second and third graphs (from the top) in FIG. 4. The uppermost graph depicts the ac waveform at the phase applied to the input terminals 13. The second graph depicts the discriminator output voltage on the gate of the SCR plotted against the same time coordinates. The third graph depicts the collector voltage of transistor 45 measured across the capacitor 47. As shown in FIG. 4, at about 80° into the positive half cycle, the gate becmes sufficiently forward biased to ignite the SCR 40 and turn on the standby lamp.

Once the main gas lamp has reached full light output, and the warm-up period is over, the voltage induced in the sense winding 45 has a value of typically 1.1 volts, corresponding to the intermediate input voltage range of the amplitude discriminator as seen in FIG. 5. In the intermediate input voltage range, the proportional voltage induced in the sense winding 44 is adequate to bring the amplifier out of cut-off, causing current flow in the load resistance 41, and occasioning a drop in the amplifier output voltage to the "low" output voltage condition. The cause of this low output voltage condition is the application of sufficient input voltage to the input junction of the transistor 45 to achieve a forward bias and normal transistor conduction, with a surplus adequate to cause the onset of low current saturation. With the input junction forward biased, the transistor 45 is turned on, collector output current flows and a lowered collector voltage results. The lowering of the collector voltage is in inverse sense to the change in input voltage—which increases. Since gain is normally present, the resultant fall in collector voltage is normally greater than the causal increase in input voltage. The diode 46 in a second series circuit connected around the sense winding 44 and including the resistance 49, is poled to establish a negative dc voltage at the emitter of the transistor 45 of about −0.4 volts. With conditions for low current saturation established, the emitter voltage and collector voltage reach a common value. Thus, the positive discharge (+0.4 volts) on capacitor 47 is discharged by conduction of transistor 45, and a negative collector potential of −0.4 volts is substituted. Assuming a diode drop of 0.6 from the diode 43, due to heavier conduction, the discriminator output voltage applied to the SCR gate is approximately +0.2 volts and below the potential required to allow the SCR to fire.

Thus, a "low" discriminator output voltage is produced when the light output of the gas lamp is normal and the sensed voltage is in the intermediate input range of the discriminator, the transistor amplifier (and the transistor 45) is operating in a 37 normal" condition. The "normal" input signal condition for an ideal amplifier is the linear region in which the input signal produces an output signal proportional to the input. For a non-ideal transistor, the "normal" condition is one in which an output produces an output substantially proportional to the input including some degree of nonlinearity near cut-off or saturation. The "normal" transistor input signal condition is one in which the input junction is forward biased, the output junction is reversely biased and normal transistor current gain action occurs, producing an inversion between the sense of the input signal and the output signal. In the linear portion of the "normal" transistor characteristic, appreciable gain is exhibited. After a small increase in input voltage past cut-off (e.g. 0.25 V), the linear region is crossed and the transistor enters low current saturation. In the current saturation region of "normal transistor operation", the incremental gain falls off, but input signal inversion continues with the low collector voltage asymmetrically approaching the emitter voltage.

When the main gas lamp transitions from warm up to the final run condition, accurate voltage discrimination and positive standby lamp control is achieved. Due to substantial transistor gain action in the amplitude discriminator, the collector output voltage falls sharply and linearly after transistor cut-off, and remains low through low current saturation as seen in the central portion of the FIG. 5 characteristic. The change in collector outut voltage between early warm-up (+0.4) and normal lamp operation (−0.4) is substantial as a result of the cumulative transistor gain intervening between cur-off and light transistor saturation. When it is desired to set a threshold for SCR operation, that threshold can be set on the rapidly falling, and therefore sensitive, linear portion of the characteristic. Recognizing that the gas lamp may stabilize at a known final voltage, the threshold may be accurately set to some accurate fraction (e.g. ¾) of the voltage. Thus, the arrangement provides substantial accuracy, limited by the variability of the SCR ignition potential, for providing turn-off of the standby lamp when adequate brightness of the main lamp is reached, and an assured turn-off of the standby lamp when the main lamp is at full brightness.

The condition for a sense voltage corresponding to a normal light output by the gas lamp are depicted in the fourth and fifth graphs (from the top) in FIG. 4. The fifth graph depicts the collector voltage. The capacitor 47, coupled to the collector, filters out most of the 20 kHz component and assumes the −0.4 volts value shown. The discriminator output voltage applied to the SCR gate is held to +0.2 volts. This voltage is insufficient to ignite the SCR and the standby lamp is kept off.

When the lamp has not yet been ignited or goes out, a "high" input voltage is produced across the sense winding 44 and a high discriminator output voltage is produced, which allows the SCR 40 to ignite. This corresponds to the rightmost portion of the FIG. 5 characteristic. The sense winding 44 produces a positive 2.0 volt (or higher) ac waveform on the base of the of the transistor 45. The diode 46 is poled to permit this direction of current flow in the sense winding. Emitter current flow through the resistance 48 develops a voltage drop across it which increases with the amount of current cnducted through it. At the onset of saturation (with a still backward biased output junction), the capacitor 47 supports a low negative charge. The incremental inverting signal gain has fallen and "normal" transistor action is nearly suspended. At the point in saturation where the input signal is sufficiently large to forward bias the output junction and cause substantial voltage drop in the emitter resistance due to emitter current, "normal" transistor action is terminated. In heavy saturation, the transistor behaves as if the transistor were two interconnected diodes without mutual current gain, having their cathodes common corresponding to the base electrode and independent anodes corresponding to the emitter and collector electrodes, respectively. In light saturation, the voltage on the capacitor 47 may fall to its lowest value. Assuming that the collector junction becomes forward biased at a low current level as by selection of a large emitter resistance, the collector potential may fall close to −0.7 volts, the minimum voltage available at the emitter due to the drop in diode 46. At the transistion from low to high current saturation, the emitter and collector voltages remain in close correspondence (<0.0005 volts) and any voltage drop in the emitter connected resistance is tracked by a corresponding increase in the collector voltage. At the transition to heavy current saturation, the input signal no longer appears in inverted voltage sense at the collector, but appears to be rectified and in an uninverted voltage sense. In heavy saturation, the signal voltage at the collector is the voltage across the sensing winding 44 less the drop of the input junction and equal to the voltage drop in the emitter coupled resistance 48. In heavy current saturation, each positive increment in input voltage at the transistor base electrode produces a positive increment in voltage drop across resistor 48 and to a corresponding increase in the output voltage at the collector electrode.

The resistance 48 is selected to prevent the input junction from carrying excessive current during high current saturation and allows for a positive growth in voltage during saturation adequate to re-cross the SCR gate threshold. In other words, the accumulated saturation induced positive increase in voltage must offset the accumulated negative decrease in voltage which occurred when the "normal" region of the transistor was transversed. In the indicated embodiment, the SCR gate threshold is readily crossed, and a higher positive output voltage appears at the collector during saturation than appears during cut-off since the amplifier has a low internal impedance in this condition when viewed as a generator. The amplifier discriminator circuit exhibits a 1 volt swing at the collector of the transistor 45 (i.e. +0.4, −0.4+0.6) and a 0.5 volt swing—assuming that the SCR fires—at the discriminator output at the SCR gate (i.e. +0.7, +0.2+0.7).

The conditions for the high sense voltage are depicted in the sixth and seventh graphs in FIG. 4. The SCR ignites and turns on the standby lamp. Here, the sense winding develops typically +0.6 volts potential at the collector output and more, if needed, at the gate of the SCR. The capacitor 47 filters out most of the 28 kHz component and produces a nearly smooth dc voltage.

In high current saturation, the phase angle is still set by the elements 41, 42, and is substantially unaffected by the availability of surplus charging current from the amplitude discriminator. In particular, the diode 43 is poled to block current flow from the collector of transistor 45 into the capacitor 42.

In summary, the amplitude discriminator produces a high output voltage for low sensed voltages, a low output for intermediate sensed voltages after a first threshold is crossed, and a high output for high sensed voltages after a second threshold is crossed. This transfer characteristic is a consequence of large signal operation of the junction transistor 45 connected in an emitter common, transistor amplifier configuration with an emitter connected resistance. In the first threshold, which represents the transition from low to intermediate input signals, the input junction of the transistor becomes forward biased past cut-off into "light" saturation with the first threshold occurring during the steep linear region. The threshold is primarily a function of the Veb of the transistor, the emitter resistance 48, and the current gain. The threshold should occur at the point in the warm-up phase of the gas discharge lamp where the brightness is about one half normal. Alternatively, it may be set to correspond to a lamp voltage of from 10 to 20 volts below a 60 volt normal operating voltage. Such control is achieved by selection of the appropriate turns ratio between windings 26 and 44.

The second threshold is primarily a function of the value of emitter resistance 48 since the diode impedances are negligibly small. The second threshold distinguishes between an unlit and a lit gaseous lamp and need not be precise since the voltage difference available at the winding 44 between an ignited lamp and an unignited lamp is not approached gradually, but represents a sudden change in lamp behaviour. The difference it produces in sensed voltage is almost two to one, and being ¾ of a volt is of nearly double the magnitude of the switching uncertainty of the SCR.

Finally, both thresholds are offset in relation to the SCR gate by the diode 46 to insure reliable switching. Thus, one may produce a reliably low output voltage (+0.2 V) to turn off the SCR and the standby light before normal lamp voltage is reached, and a reliably high output voltage (+0.8 V) to turn on the SCR and the standby lamp while the gas lamp is below normal light output or has gone out. The discriminator output voltage is positive in its turn-off control action in holding the SCR off by staying below the minimum of a wide range of potential gate firing potentials, and equally positive in its turn-on control action since discriminator output voltage will increase substantially to satisfy any conventional maximum SCR firing potential.

The desired amplitude discriminator characteristic may be achieved in other ways. In the principal embodiment, the active element is a junction transistor connected in an emitter common amplifier configuration including a substantial emitter connected resistance. The transistor is operated in the large signal mode, being held cut off for the low valued warm-up lamp voltage; being taken through the normal inverting gain region to low current saturation for normal operating lamp voltages; and finally being taken into high current saturation whenever the lamp is off. High current saturation is anomalous in that the output junction is forward biased, normal transistor action suspended, and an "uninverted" voltage output is developed in the emitter resistance, and transferred to the collector electrode. This junction transistor configuration is the simplest.

One variant amplitude discriminator of slightly greater complexity but comparable cost also uses a junction transistor in a transistor amplifier configuration. In this second embodiment, shown in FIG. 6, an equivalent base connected resistance (B $R_b$) is substituted for the emitter connected resistance of the principal embodiment and a supplemental diode is provided connected in shunt with the base connected resistance and the output junction of the transistor.

Figure 6:
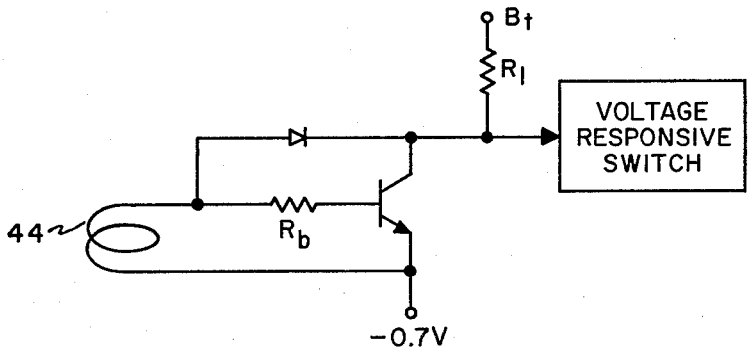
FIG. 6 illustrates a second form of transistor amplitude discriminator, also using a junction transistor, but using a supplemental diode.

The amplitude discriminator shown in FIG. 6 has a very similar transfer characteristic to that of the first embodiment. During warm-up and normal run lamp conditions, the transistor in the second embodiment is in the cut-off and active regions in the same manner as in the first embodiment. Early saturation is also similar, with the current in both input and output junctions being limited by the base connected resistance. The supplemental diode may be on the verge of conduction or off. The minimum negative voltage will be about −0.4 volts assuming a counterpart for the offset diode 46. The condition for full diode conduction and entry into the third region of the amplitude discriminator characteristic is that the collector current be significantly less than the signal current times the transistor beta:

$$\beta I_n > I_{out}$$

This may be achieved by selection of a small ratio of bias potential B+ to load resistance ($R_L$)

$$\beta I_n > \frac{B+}{R_L}$$

When the highest signal voltage (i.e. 2 volts) occurs on the winding 44, corresponding to de-ignition of the gas lamp, diode conduction pulls the transistor out of saturation and converts the transistor into a resistive load coupled through the supplemental diode to the winding 44. The collector voltage will rise from this point on with substantially unity gain. Since the collector current is held to a reasonable value by the base resistance, and will not unduly load the winding 44, the collector voltage under a 2 volt sense voltage will climb to about +0.7 volts (subtracting the drops in the supplemental diode and assuming that an offset diode corresponding to diode 46 is also used in circuit).

The second configuration depends on normal transistor action through cut-off, the linear region and light saturation to produce the initialhigh portion and the central low portion of the amplitude discriminator transfer characteristic. The supplemental diode transfers an uninverted signal to an output circuit to provide the final "high" portion of the transfer characteristic with the transistor acting as a load to the signal source. In both embodiments the first threshold is set in the steeply sloping linear region of the transistor following directly after cut-off. This threshold occurs at a voltage established by the nature of the input junction—the Veb. The second threshold is on the more gradual slope corresponding to an un-inverting gain of approximately one provided by the diode load.

Figure 7:
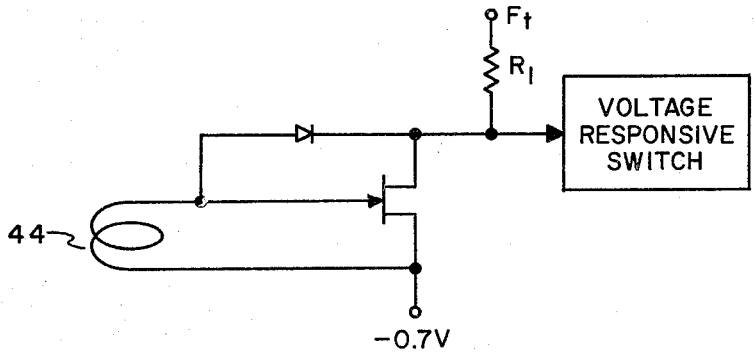
FIG. 7 illustrates a third form of transistor amplitude discriminator using a field effect transistor and a supplemental diode.

A third configuration using an N channel enhancement mode field effect transistor and a supplemental diode is shown in FIG. 7. In this third configuration, the supplemental diode is coupled between the gate and the drain and serves to couple uninverted signals to the drain during outage of the gas lamp. The FET has a threshold due to geometry and energization and will produce the same threshold effects of a junction device. Entry into the region of non-inverting gain requires that the diode become forward biased at device saturation, a condition that is met by selection of an adequately small ratio of bias potential (B+) to load resistance $$gm\ E_m > \frac{B+}{R_L}$$

where gm is the transconductance of the transistor. The configuration of FIG. 7 will also achieve a high, low, high transfer characteristic similar to that of the other two configurations.

The desired amplitude discriminator transfer characteristic may be achieved with a variety of devices of which the simplest and least expensive are the solid state devices herein described. The principal embodiments have a substantial advantage over the more cumbersome and expensive traditional electromechanical devices. At the present state of the art, these embodiments are also cheaper than a direct solid state logic design using digital techniques.

While the amplitude discriminator transfer characteristic achieved in the present embodiments share the particularities of the solid state devices employed, their utility in controlling a standby lamp for a gas discharge lamp is uncompromised. As noted earlier, the principal embodiment has a transfer characteristic in which the initial low input signal region has a flat high plateau corresponding to transistor cut-off. The intermediate region has a sharp downward slope which verges into a more gradual slope, ending in a low, nearly horizontal line as the device saturates, corresponding to the active region of the transistor. The final region has a gradual upward slope corresponding to a gain of about unity, arising from the voltage drop in the emitter load while the transistor remains saturated. The initial slope is steep enough to allow one to produce positive switching at a preselected lamp voltage corresponding to a desired degree of light output as the lamp gradually warms up. The more gradual final slope is not harmful because the voltage on the lamp terminals makes a large step discontinuity in igniting or de-igniting, the other conditions to which the control responds, providing a positive and unambiguous switching control signal. The switching remains positive with switching devices such as SCR devices, which may have as much as a one-half volt uncertainty from device to device, or other electrically controlled switches which may have hysteresis between turn on and turn off. Finally, while certain particulars of the transfer characteristic flow naturally from the semiconductor devices employed, it should be noted that certain aspects are not essential. In particular, one could have initial and terminal plateaus with a central valley linked to the other portions with step transitions.

The control circuit herein described is of a simple design, and provides a minimum of interference with the restart function. The sense winding 44 typically has one turn while the power winding 26 has 150 turns. The load for the sense winding is above 50 ohms in the hard saturation region of the transistor and thus the reflected load during an off state is above 1,125,000 ohms when restarting is sought. Since the quantity sampled bythe sense winding is used to control a transistor, any adverse loading on the starting voltages can be further reduced by using a higher gain transistor or an additional stage allowing a higher input impedance. It should be noted that the loading that does exist is both very light and resistive and does not contain resonances or other abrupt changes in impedance with level or frequency. This aids the smooth transition from original breakdown to final running of the lamp.

While circuit values have been selected corresponding to a particular gas discharge lamp, it should be evident that the same principles will apply to devices having higher or lower voltages over a wide range of power ratings.

It is normally desirable that the gas discharge lamp be restarted as quickly as possible after it has gone out. To hasten re-ignition, an ignition winding 50 of typically 5 turns is provided wound on the secondary arm of the core closely coupled to the secondary winding 26. The winding 26 is connected in series with a capacitor 51, and the LC circuit so formed is connected in series with the anode and cathode of the SCR 40. When the SCR is off, but 120 volt ac is applied to the input terminals 13, the circuit charges up through the filament of the incandescent lamp 12 to a value slightly below the instantaneous line voltage. Should the SCR not be allowed to ignite, the impedances of the capacitor 51 and winding 50 are selected so that the normal resonant frequency is many times higher than the 60 cycle line voltage, and a small voltage is developed in the ignition winding. Should the SCR be allowed to ignite, it will ignite at about 80°. Ignition by the SCR produces a sudden oscillatory discharge of the series resonant circuit. With the values indicated, the resonant frequency is near 200 kilohertz. The voltage at which firing occurs is near the peak of the ac waveform and is transformed up by the 5 to 150 turns ratio. The result is a 4,000 to 5,000 volt peak to peak r.f. waveform at the lamp terminal. The oscillatory discharge is superimposed on the 20 kHz inverter output. In the non-ignited state, the inverter output is 1,000 volts. Thus, a peak voltage between 3,000 to 4,000 volts is available to restart the light source. As the circuit indicates, the re-ignition circuit for the gas discharge lamp is designed to come on only when the SCR is turned on. The circuit hastens re-ignition from a typical value of about 45 seconds to about 20 to 25 seconds.

The term "silicon controlled rectifier" applied to the power switch 40 has been used in the preceding text to spell out the meaning of the abbreviation "SCR". The "S" in the abbreviation is commonly regarded as standing for the material silicon in view of the fact that silicon is the material commonly used for the device. In principle, the silicon material could be replaced by other semiconductor materials without a change in the fundamental mode of operation. Consistently, the "S" in the abbreviation is also commonly regarded as standing for the word "semiconductor", with the intention to embrace devices not based on a silicon semiconductor material. Finally, while a very high percentage of known SCR devices are poled as indicated and use a "p" type gate region, a small percentage are poled in a complementary fashion and use an "n" type gate region. It is evident that both "complementary" and non-silicon SCRs can be used in the inventive circuit. If a complementary SCR is used, adaptive circuit changes such as the use of a complementary sensing transistor and a reversal of the poling of the diodes (43 and 46) is required. The switching function can be performed by non-SCR semiconductor devices as, for instance, the "triac" or silicon controlled switch or by voltage responsive mechanical switching. The common silicon SCR has both an economic advantage and greater reliability than the known substitutes and is therefore preferred.

The amplitude discriminator herein described is shown operated with an input derived from a gas discharge lamp having a high frequency supply, and using a ferrite power transformer to derive an alternating input voltage. The amplitude discriminator may also be used with a gas discharge lamp which is powered by a dc supply, where the proportional voltage is a dc quantity derived by a voltage divider or other means.

What is claimed as new and desired to be secured by Letters Patent of the United States is:

1. A lighting network comprising:

(a) a main gas discharge lamp having terminals for connection to a source of electrical energy, said main lamp having a low temperature ignited state with a low light output; and an operating temperature ignited state with a normal light output, (b) first power supply means coupled to said main lamp terminals for supplying an operating potential;

said lamp potential, when connected to said power supply means, being low at said low temperature ignited state and normal at said operating temperature ignited state, (c) a standby lamp for use when said main lamp is below normal light output, (d) a second power supply means for operating said standby lamp, and (e) control means including:

(1) an amplitude discriminator comprising a transistor amplifier exhibiting cut-off at a low input range and active operation with input inversion at a higher input range to effect a transfer characteristic in which electrical inputs in said low and higher ranges respectively, produce an output quantity in respectively a first range and a second range distinct from said first range, (2) means coupling a voltage proportional to said main lamp voltage to said discriminator to effect amplifier cut-off when said main lamp is in the low voltage, low temperature ignited state, and active input inversion when said main lamp is in the normal voltage, operating temperature ignited state, and (3) switching means coupled to the output of said discriminator for applying power from said first power supply means to said standby lamp for amplitude discriminator outputs in said first range and for removing power for outputs in said second range.

2. A lighting network as set forth in claim 1 wherein (a) said transistor amplifier comprises a transistor having base, emitter and collector electrodes forming an input and an output junction, and wherein (b) said proportional voltage at the transition from cut-off to active input inversion corresponds to the voltage required to forward bias said input junction.

3. A lighting network as set forth in claim 2 wherein said proportional voltage at said transition from cut-off to active input inversion is substantially equal to the Veb drop of said input junction.

4. A lighting network as set forth in claim 2 wherein (a) said transistor amplifier comprises a field effect transistor of the n-channel enhancement mode having gate, source and drain electrodes, (b) said amplifier including means for providing a positive bias to said drain and a negative bias to said source, and (c) said proportional voltage at the transition from cut-off to normal operation of said amplifier corresponds to the threshold of said field effect transistor.

5. A lighting network comprising:

(a) a main gas discharge lamp having terminals for connection to a source of electrical energy, said main lamp having an off state, a low temperature ignited state with a low light output, and an operating temperature ignited state with a normal light output, (b) first power supply means coupled to said main lamp terminals for supplying an operating potential;

said lamp potential, when connected to said power supply means, being low at said low temperature ignited state, normal at said operating temperature ignited state, and elevated above normal when said lamp is off, (c) a standby lamp for use when said main lamp is below normal light output, (d) second power supply means for operating said standby lamp, and (e) control means including:

(1) an amplitude discriminator comprising a transistor amplifier exhibiting cut-off at a low input range; active operation with input inversion at an intermediate input range; and an uninverted input transfer at a high input range to effect a transfer characteristic in which electrical inputs in said low, intermediate and high ranges respectively produce an output quantity in respectively a first range, a second range distinct from the first range, and said first range, (2) means coupling a voltage proportional to the voltage across said main lamp to said discriminator to effect cut-off when said main lamp is in the low voltage, low temperature ignited state; active input inversion when said main lamp is in the normal voltage, operating temperature ignited state; and an uninverted input transfer when said main lamp is off and has an elevated voltage, and (3) switching means coupled to the output of said discriminator for applying power from said power supply means to said standby lamp for amplitude discriminator outputs in said first range and for removing power for outputs in said second range.

6. A lighting network as in claim 5 wherein (a) said first power supply means comprises a transformer, a secondary winding of which is coupled to the terminals of said discharge lamp, and (b) said proportional coupling means comprises a step down winding responsive to the flux in said secondary winding and coupled to said discriminator input.

7. A lighting network as in claim 5 wherein (a) said transistor amplifier comprises (1) a junction transistor having base, emitter and collector electrodes forming an input and an output junction;

(2) a base connected resistance;

(3) a diode shunting said resistance and said output junction and of similar polarity to said output junction; and wherein (b) said proportional voltage at the transition from cut-off to active input inversion corresponds to the voltage required to forward bias said input junction, and during said uninverted input transfer corresponds to the voltage required to forward bias said diode and to develop a voltage drop in said base resistance.

8. A lighting network as in claim 5 wherein (a) said transistor amplifier comprises (1) a field effect transistor of the n-channel enhancement mode, having gate, source and drain electrodes, (2) biasing means for providing a positive bias to said drain and a negative bias to said source, and (3) a diode coupled between said gate and drain electrodes poled to permit current flow from said gate to said drain, and (b) said proportional voltage at the transition from cut-off to normal operation of said amplifier corresponds to the threshold to said field effect transistor, and during said uninverted input transfer corresponds to the voltage required to forward bias said diode.

9. A lighting network as in claim 5 wherein said proportional coupling means is a step down transformer coupled between said first power supply means and said discriminator input.

10. A lighting network as in claim 5 wherein (a) said transistor amplifier comprises (1) a junction transistor having base, emitter and collector electrodes forming an input and an output junction;

(2) an emitter connected resistance; and wherein (b) said proportional voltage at the transition from cut-off to active input inversion corresponds to the voltage required to forward bias said input junction, and during said uninverted input transfer corresponds to the voltage required to forward bias said output junction and to develop a voltage drop in said emitter resistance.

11. A lighting network as in claim 10 wherein (a) means are provided to offset the potential at said transistor collector electrode in respect to a common terminal of reference potential to place said collector potential above said reference potential in one discriminator output range and below said reference potential in the other output range; and wherein (b) said switching means is a semiconductor controlled rectifier whose cathode is coupled to said reference potential and whose gate is coupled for response to said collector potential.

12. A lighting network as in claim 11 wherein (a) said transistor is an NPN transistor, (b) said switching means is a silicon controlled rectifier turned on by a positive gate potential, and (c) said offset means is a diode coupled between said emitter and said terminal at reference potential, said step down winding being coupled across the series circuit comprising said input junction and said emitter resistance, said diode being poled to reduce said emitter potential one diode drop below reference potential.

13. A lighting network as in claim 12 wherein (a) said second power supply means is an ac source having a common terminal at said reference potential, and the other terminal variable with respect thereto; and wherein (b) a phase shift network is provided for determining the phase angle of said ac source at which said silicon controlled rectifier ignites, said phase shift network comprising a resistor coupled between said other ac source terminal and the gate of said silicon controlled rectifier, and a first capacitor coupled between said gate and said cathode, and (c) a diode is provided, coupled between said gate and said transistor collector, said connection clamping said gate potential to a value below the ignition potential of said silicon controlled rectifier in said second discriminator output range and blocking reverse current flow in said first discriminator output range for isolating said phase shift network during SCR ignition.

14. A lighting network as in claim 13 wherein said first power supply means operate at an above audible frequency suitable for operation of a gaseous discharge lamp, and a smoothing capacitor is provided coupled between the collector electrode of said transistor and said common terminal of reference potential for preventing instability, said coupling diode isolating said smoothing capacitor from said phase shift network.

15. A lighting network as in claim 14 having in addition thereto an ignition circuit for said main light source comprising:

(a) a series resonant circuit connected between the anode and cathode of said silicon controlled rectifier and in series with said standby light source across said ac source, ignition at said SCR turning on said standby light source and discharging said series resonant circuit, said series resonant circuit comprising:

(1) a winding inductively coupled to and producing a stepped up voltage in said transformer secondary winding, and (2) a resonating capacitor, (b) said phase shift network delaying the ignition of said silicon controlled rectifier until adequate energy is stored in said series resonant circuit to ignite said main light source.

* * * * *